US006343594B1

(12) United States Patent
Koeslin et al.

(10) Patent No.: US 6,343,594 B1
(45) Date of Patent: Feb. 5, 2002

(54) VARIABLE FLOW VENTURI ASSEMBLY FOR USE IN AN EXHAUST GAS RECIRCULATION SYSTEM OF AN INTERNAL COMBUSTION ENGINE

(75) Inventors: Werner H. Koeslin, Peoria; John R. Weber, Chillicothe, both of IL (US)

(73) Assignee: Caterpillar Inc., Peoria, IL (US)

( * ) Notice: Subject to any disclaimer, the term of this patent is extended or adjusted under 35 U.S.C. 154(b) by 26 days.

(21) Appl. No.: 09/589,324

(22) Filed: Jun. 1, 2000

(51) Int. Cl.[7] ..... F02M 25/07

(52) U.S. Cl. ..... 123/568.17; 123/568.26; 123/568.11

(58) Field of Search ..... 123/568.11, 568.12, 123/568.17, 568.18, 568.19, 568.2, 568.26, 568.27, 568.29; 60/605.2

(56) References Cited

U.S. PATENT DOCUMENTS

| | | | | | |
|---|---|---|---|---|---|
| 1,539,126 | A | | 5/1925 | Link | 123/568.17 |
| 2,354,179 | A | | 7/1944 | Blanc | 123/568.17 |
| 3,680,534 | A | | 8/1972 | Chavant | 123/568.17 |
| 3,996,748 | A | | 12/1976 | Melchior | 60/605.2 |
| 4,090,483 | A | * | 5/1978 | Weidlich | 123/568.11 |
| 4,285,318 | A | * | 8/1981 | Yoneda et al. | 123/568.29 |
| 4,461,150 | A | | 7/1984 | Grohn | 60/605.2 |
| 4,634,371 | A | * | 1/1987 | Bader | 123/568.17 |
| 4,635,609 | A | | 1/1987 | Seppen et al. | 123/568.17 |
| 4,693,226 | A | | 9/1987 | Choma | 123/568.17 |
| 4,840,164 | A | | 6/1989 | Parsons | 123/568.17 |
| 5,533,487 | A | | 7/1996 | Cailey | 123/568.17 |
| 5,611,204 | A | | 3/1997 | Radovanovic et al. | 60/605.2 |
| 6,044,827 | A | * | 4/2000 | Pfaff et al. | 123/568.18 |

* cited by examiner

*Primary Examiner*—Willis R. Wolfe
(74) *Attorney, Agent, or Firm*—Taylor & Aust, P.C.

(57) ABSTRACT

A variable flow venturi assembly for use in an exhaust gas recirculation system of an internal combustion engine having a housing with an inner chamber, a combustion air inlet in communication with the inner chamber, and an exhaust gas inlet in communication with the inner chamber. A venturi valve is slidably disposed within the chamber. A venturi valve has a longitudinally extending throughhole with an inlet opening in communication with the combustion air inlet, an outlet opening and a venturi section interposed and in communication with each of the inlet opening and the outlet opening. The venturi valve further has at least one bypass port and at least one induction port. Each bypass port is in communication with a combustion air inlet and a throughhole. Each induction port is in communication with the exhaust gas inlet and the throughhole. An actuator slidably moves the venturi valve within the inner chamber of the housing.

23 Claims, 1 Drawing Sheet

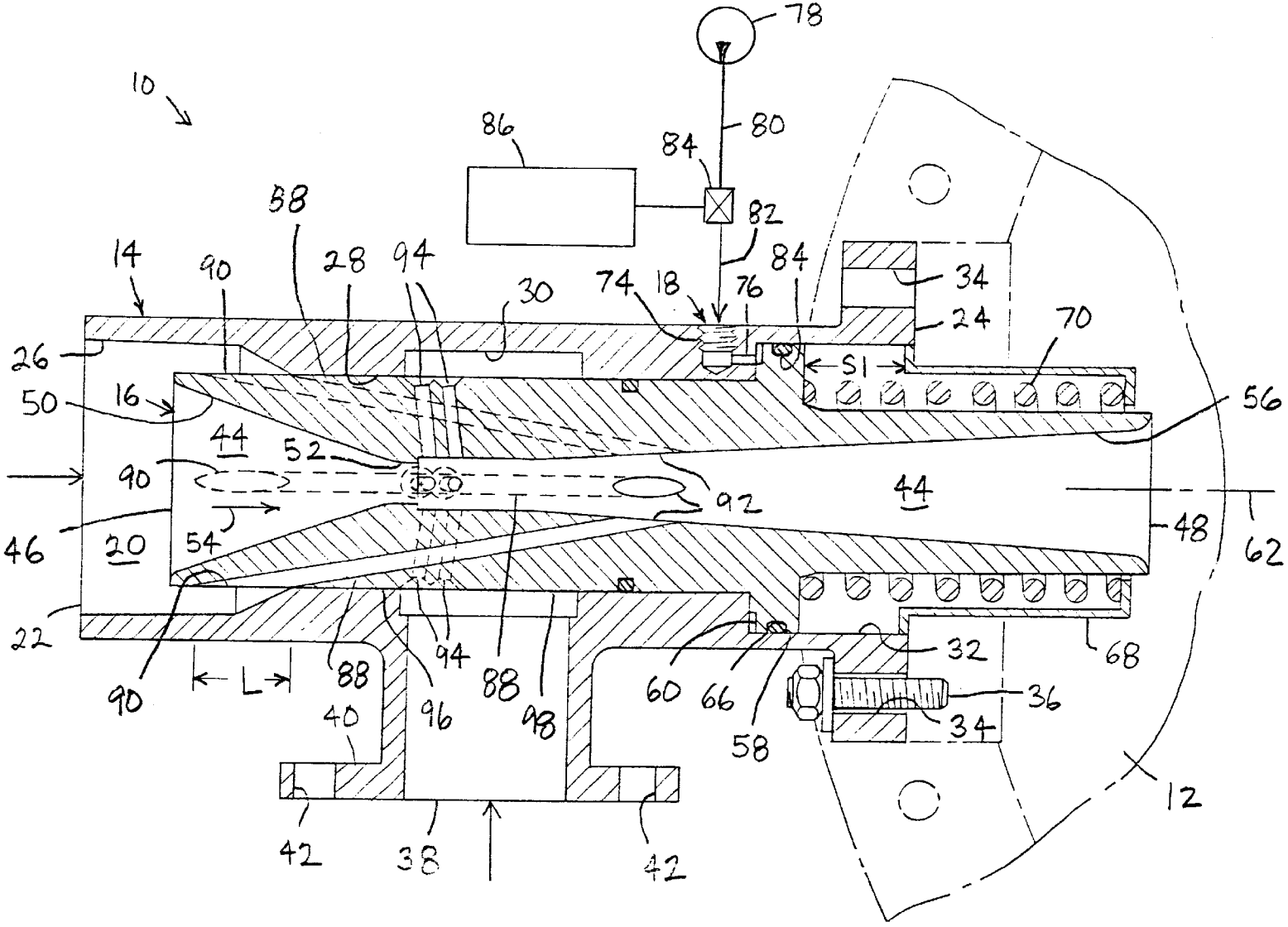
10
12
14
16
18
20
22
24
26
28
30
32
34
36
38
40
42
44
46
48
50
52
54
56
58
60
62
66
68
70
74
76
78
80
82
84
86
88
90
92
94
96
S1
L

VARIABLE FLOW VENTURI ASSEMBLY FOR USE IN AN EXHAUST GAS RECIRCULATION SYSTEM OF AN INTERNAL COMBUSTION ENGINE

TECHNICAL FIELD

The present invention relates to internal combustion engines, and, more particularly, to a variable flow venturi assembly for use in an exhaust gas recirculation system of an internal combustion engine.

BACKGROUND ART

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NoX). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

When utilizing EGR in a turbocharged diesel engine, the exhaust gas to be recirculated is preferably removed upstream of the exhaust gas driven turbine associated with the turbocharger. In many EGR applications, the exhaust gas is diverted directly from the exhaust manifold. Likewise, the recirculated exhaust gas is preferably reintroduced to the intake air stream downstream of the compressor and air-to-air after cooler (ATAAC). Reintroducing the exhaust gas downstream of the compressor and ATAAC is preferred due to the reliability and maintainability concerns that arise if the exhaust gas passes through the compressor and ATAAC. An example of such an EGR system is disclosed in U.S. Pat. No. 5,802,846 (Bailey), which is assigned to the assignee of the present invention.

With conventional EGR systems as described above, the charged and cooled combustion air which is transported from the ATAAC is at a relatively high pressure as a result of the charging from the turbocharger. Since the exhaust gas is also typically inducted into the combustion air flow downstream of the ATAAC, conventional EGR systems are configured to allow the lower pressure exhaust gas to mix with the higher pressure combustion air. Such EGR systems may include a venturi section which induces the flow of exhaust gas into the flow of combustion air passing therethrough. An efficient venturi section is designed to Apump@ exhaust gas from a lower pressure exhaust manifold to a higher pressure intake manifold. However, because varying EGR rates are required throughout the engine speed and load range, a variable orifice venturi may be preferred. Such a variable orifice venturi is physically difficult and complex to design and manufacture. Accordingly, venturi systems including a fixed orifice venturi and a combustion air bypass circuit are conventionally favored. The bypass circuit consists of piping and a butterfly valve in the EGR flow path. The butterfly valve is controllably actuated using an electronic controller which senses various parameters associated with operation of the engine. The controllable actuator associated with the butterfly valve for controlling the EGR flow rate typically is connected with the butterfly valve through appropriate mechanical linkages, etc. Although such systems may provide effective EGR, they may be relatively complicated, difficult and expensive to manufacture, and may require replacement more often.

The present invention is directed to overcoming one or more of the problems as set forth above.

DISCLOSURE OF THE INVENTION

In one aspect of the invention, a variable flow venturi assembly for use in an exhaust gas recirculation system of an internal combustion engine having a housing with an inner chamber, a combustion air inlet in communication with the inner chamber, and an exhaust gas inlet in communication with the inner chamber. A venturi valve is slidably disposed within the chamber. A venturi valve has a longitudinally extending throughhole with an inlet opening in communication with the combustion air inlet, an outlet opening and a venturi section interposed and in communication with each of the inlet opening and the outlet opening. The venturi valve further has at least one bypass port and at least one induction port. Each bypass port is in communication with a combustion air inlet and a throughhole. Each induction port is in communication with the exhaust gas inlet and the throughhole. An actuator slidably moves the venturi valve within the inner chamber of the housing.

In another aspect of the invention, an internal combustion engine having an intake manifold and a variable flow venturi assembly. The variable flow venturi assembly has a housing, a venturi valve and an actuator. The housing is attached to the intake manifold, and has an inner chamber, a combustion air inlet in communication with the inner chamber, and an exhaust gas inlet in communication with the inner chamber. The venturi valve is slidably disposed within the inner chamber. The venturi valve has a longitudinally extending throughhole with an inlet opening in communication with the combustion air inlet, an outlet opening and a venturi section interposed and in communication with each of the inlet opening an the outlet opening. The venturi valve further has at least one bypass port and at least one induction port. Each bypass port is in communication with the combustion air inlet and the throughhole. Each induction port is in communication with the exhaust gas inlet and the throughhole. An actuator slidably moves the venturi valve within the chamber of the housing.

In yet another aspect of the invention, a method of operating a variable flow venturi assembly in an exhaust gas recirculation system of an internal combustion engine has the steps of: providing a housing having an inner chamber, a combustion air inlet in communication with the inner chamber, and an exhaust gas inlet in communication with the inner chamber; providing a venturi valve slidably disposed within the inner chamber, the venturi valve has a longitudinally extending throughhole with an inlet opening in communication with the combustion air inlet, an outlet opening and a venturi section interposed and in communication with each of the inlet opening and the outlet opening, the venturi valve further has at least one bypass port and at least one induction port, each bypass port in communication with the combustion air inlet and the throughhole, each induction port in communication with the exhaust gas inlet and the throughhole; moving the venturi valve in a slidable manner within the inner chamber of the housing using an actuator; and covering each bypass port a selected amount dependent upon the moving step.

BRIEF DESCRIPTION OF THE DRAWINGS

The FIGURE is a side, sectional view of an embodiment of a variable flow venturi assembly of the present invention for use in an exhaust gas recirculation system of an internal combustion engine.

BEST MODE FOR CARRYING OUT THE INVENTION

Referring now to the drawing, there is shown an embodiment of a variable flow venturi assembly 10 of the present invention which is attached to an intake manifold 12 of an internal combustion engine. Variable flow venturi assembly 10 forms part of an EGR system which is used to recirculate the exhaust gas from an exhaust manifold (not shown) of the internal combustion engine to intake manifold 12. Intake manifold 12 is connected in known manner to a plurality of combustion cylinders, with each combustion cylinder having a corresponding piston which is movable in a reciprocal manner therein. The relative motion between the different pistons may be dependent upon each other in the case of a crank shaft engine, or may be independent of each other in the case of a free piston engine.

Variable flow venturi assembly 10 generally has a housing 14, a venturi valve 16 and an actuator 18. Housing 14 has an inner chamber 20 extending in a longitudinal manner from a combustion air inlet 22 to a mounting flange 24. Inner chamber 20 includes multiple adjacent surfaces, with a larger diameter portion 26, a smaller diameter portion 28, a first annular recess 30 and a second annular recess 32. Combustion air inlet 22 receives combustion air which is used within the combustion cylinders attached to intake manifold 22. More particularly, in the embodiment shown, combustion air inlet 22 receives compressed and cooled combustion air from an after cooler which is attached to a compressor of a turbocharger. Such a turbocharger and after cooler are well known in the art, and will not be described in further detail hereinafter.

Mounting flange 24 allows housing 14 of variable flow venturi assembly 10 to be connected with intake manifold 12 in a suitable manner. In the embodiment shown, mounting flange 24 has a plurality of holes 34 which receive corresponding fasteners such as a stud 36 for attaching housing 14 to intake manifold 12. Of course, variable flow venturi assembly 10 may be connected to intake manifold 12 in any suitable manner.

Housing 14 also has an exhaust gas inlet 38 which is in communication with inner chamber 20 and which receives exhaust gas from an exhaust manifold (not shown) of the internal combustion engine. Exhaust gas inlet 38 is appropriately configured to allow interconnection with the exhaust manifold of the internal combustion engine. In the embodiment shown, exhaust gas inlet 38 has an annular flange 40 allowing housing 14 to be bolted together in a suitable manner with other appropriate pipes, conduits, etc. using bolts or studs which pass through bolt holes 42. Exhaust gas inlet 38 is in communication with first annular recess 30 forming a part of inner chamber 20.

Venturi valve 16 is slidably disposed within inner chamber 20. Venturi valve 16 has a longitudinally extending throughhole 44 with an inlet opening 46 in communication with combustion air inlet 22, an outlet opening 48 in communication with intake manifold 12, and a venturi section 50 interposed and in communication with each of inlet opening 46 and outlet opening 48. Venturi section 50 tapers in a constricting manner from inlet opening 46 to constrict the flow of combustion air therethrough, and thereby cause the velocity of the combustion air to increase and the pressure of the combustion air to decrease. Venturi section 50 terminates at a venturi throat 52, relative to a direction of flow indicated by arrow 54. Throughhole 44 also has an expansion section 56 which is disposed downstream from venturi section 50, between venturi section 50 and outlet opening 48. Expansion section 56 allows the combustion air which flows through venturi section 50 to expand on the downstream side of venturi throat 52.

Venturi valve 16 also has an annular flange 58 with a diameter which is larger than smaller diameter portion 28 of inner chamber 20. Annular flange 58 has an annular shoulder 60 which faces in an axial direction relative to a longitudinal axis 62 of venturi valve 16. Annular flange 58 also has a circumferential groove 64 which carries an 0-ring 66 or any other type of seal for sealing between annular flange 58 and housing 14.

Venturi valve 16 is movable within housing 14 a distance corresponding to the stroke length of annular flange 58 within second annular recess 32. More particularly, venturi valve 16 is movable between extreme positions a distance corresponding to the stroke length S1 between annular flange 58 and a cover 68 carried within second annular recess 32 adjacent mounting flange 24. A compression spring 70 which abuts cover 68 and an annular shoulder 72 disposed on a side of annular flange 58 opposite from annular shoulder 60 biases venturi valve 16 to the position shown in the figure.

Actuator 18 is in the form of a pneumatic actuator which applies pressure in the form of air pressure to annular shoulder 60 of annular flange 58 to move venturi valve 16 to a selected position within housing 14. More particularly, actuator 18 has a threaded port 74 which is connected to one or more branch channels 76 leading to annular shoulder 60. A small annular recess (not numbered) adjacent annular shoulder 60 allows the fluid pressure transported through branch channel 76 to be evenly applied to annular shoulder 60. Threaded port 74 is internally threaded and allows actuator 18 to be easily connected with a source of pressurized air 78 through appropriate fluid conduits, hoses, etc., schematically represented by lines 80 and 82 in the figure. A controllable valve 84 is interposed between lines 80 and 82 and allows the pressure and duration of the air which is supplied to threaded port 74 to be controlled using a controller 86 connected therewith. Controller 86 may receive appropriate input signals from various sensors associated with the internal combustion engine to controllably actuate valve 84. For example, controller 86 may actuate valve 84 dependent upon load characteristics, engine temperature, etc.

Venturi valve 16 also has a plurality of bypass ports 88 extending therethrough. Each bypass port 88 has an inlet 90 associated with larger diameter portion 26 of inner chamber 20, and an outlet end 92 disposed in communication with and terminating within expansion section 56 of throughhole 44. Each inlet end 90 terminates at a radially outward periphery of venturi valve 16, and thus has a substantially oblong shape as illustrated. Likewise, outlet end 92 of each bypass port 88 contacts expansion section 56 of throughhole 44 at an oblique angle and thus also has oblong shape as illustrated.

Bypass ports 88 allow a predetermined amount of combustion air to bypass venturi section 50, dependent upon the longitudinal displacement position of venturi valve 16 within housing 14. More particularly, each inlet end 90 has a length L in the longitudinal direction which is approximately the same as the stroke length S1 of venturi valve 16 within housing 14. Venturi valve 16 may be slidably displaced within housing 14 using actuator 18 to a desired longitudinal position, as described above. Dependent upon the selected longitudinal position of venturi valve 16 within housing 14, a corresponding amount of each inlet end 90 is covered by smaller diameter portion 28 of inner chamber 20. When venturi valve 16 is in the position shown in the drawing, each inlet end 90 is fully open so that a maximum amount of combustion air can bypass venturi section 50. Conversely, when pneumatic pressure is exerted by actuator 18 to move venturi valve 16 to the right the maximum distance S1 shown in the drawing, each inlet end 90 is substantially entirely covered by smaller diameter portion 28 of inner chamber 20. By varying the amount of combustion air which flows through bypass ports 88, the amount of combustion air which flows through venturi throat 52 is likewise variably controlled.

Venturi valve 16 also has a plurality of induction ports 94. Each induction port 94 has an inlet (not numbered) disposed in communication with exhaust gas inlet 38 and an opposite end (not numbered) which extends to and terminates at throughhole 44 of venturi valve 16. Each induction port 94 transports exhaust gas from first annular recess 30 into throughhole 44 of venturi valve 16 for mixing with the combustion air transported through venturi throat 52. Each induction port 94 may have an end which is sized, shaped and configured to provide proper fluid exhaust gas into throughhole 44, and which promotes pressure recovery through diffusion within throughhole 44.

In the embodiment shown, each induction port 94 is always substantially open, regardless of the position of venturi valve 16 within housing 14. That is, each induction port 94 may be moved to the right a maximum distance corresponding to stroke length S1, dependent upon the position of venturi valve 16 within housing 14. It is thus appreciated that induction ports 94 are always open, regardless of the position of venturi valve 16 within housing 14. It is also possible to position induction ports 94 such that the inlet ends are substantially covered by smaller diameter portion 28 of inner chamber 20. For example, the inlet end of each induction port 94 may be positioned at or near location 96 of smaller diameter portion 28. Conversely, it is also possible to position the inlet end of each induction port 94 such that it is open when each bypass port 88 is in the full bypass position as shown, and substantially closed when venturi valve 16 is moved to the rightmost position corresponding to stroke length S1. For example, the inlet end to each induction port 94 may be positioned at or near location 98 when venturi valve 16 is in the full bypass position shown in the figure. The exact configuration of induction ports 94 and the exact positioning of the inlet ends and outlet ends of each induction port 94 may vary dependent upon the specific application.

Industrial Applicability

During use, combustion occurs within the combustion cylinders of the internal combustion engine associated with intake manifold 12 in known manner. The exhaust gas from the combustion cylinder drives a turbine side of a turbocharger, which in turn drives a compressor side of a turbocharger providing compressed combustion air to intake manifold 12. The compressed combustion air is cooled with an after cooler (not shown) and is then transported to combustion air inlet 2 of variable flow venturi assembly 10. Additionally, a portion of the exhaust gas from the exhaust manifold of the internal combustion engine is directed through appropriate fluid conduits, etc. to exhaust gas inlet 38 of variable flow venturi assembly 10. Dependent upon load, temperature or other parameters associated with operation of the internal combustion engine, controller 86 controls a flow of pressurized air from air source 78 to actuator 18. The amount and/or pressure of the air which is supplied to actuator 18 is controlled with controller 86 using valve 84. The pressurized air exerts an axial force against shoulder 60 which moves venturi valve 16 to a selected position within housing 14. Compression spring 70 opposes the force applied by the air pressure against shoulder 60 such that venturi valve 16 is held at a selected location in a stationary manner within housing 14. The selected location of venturi valve 16 in turn covers each inlet end 90 of bypass ports 88 a predetermined amount. The amount of area of each inlet end 90 which is uncovered determines the amount of combustion air which bypasses venturi section 50 through bypass ports 88. By controlling the amount of air which bypasses through bypass ports 88, the amount of combustion air which flows through venturi section 50 is likewise controlled. The magnitude of the vacuum pressure within venturi throat 52 and adjacent the outlet of each induction port 94 is a function of the amount of air which flows through venturi throat 52. This vacuum pressure determines the amount of exhaust gas which is induced through induction ports 94 to mix with the combustion air which flows through venturi throat 52. Thus, by controlling the amount of air which bypasses through bypass ports 88, the amount of exhaust gas which mixes with the combustion air is likewise controlled. Combustion air with a predetermined amount of exhaust gas mixed therewith flows from outlet opening 48 of venturi valve 16 and into intake manifold 12 for use within the combustion cylinders of the internal combustion engine.

The present invention provides a variable flow venturi assembly 10 which is used to control and allows easy adjustment of the exhaust gas which is mixed with the combustion air. The venturi valve may be displaced to a selected location using a pneumatic actuator, thereby covering the bypass ports a predetermined amount and controlling the flow of combustion air to the venturi section to in turn control the amount of exhaust gas which is mixed therewith. The induction ports for inducing the exhaust gas into the flow of combustion air have inlets which may be selectively placed such that the inlets are always opened or sometimes open, dependent upon the position of venturi valve 16 within housing 14. The length of the inlet end of each bypass port 88 is preferably selected to correspond to the stroke length S1 of venturi valve 16 within housing 14, thereby moving bypass ports 88 from a full bypass position to a full closed position, dependent upon the position of venturi valve 16 within housing 14. The amount of force which is required to move venturi valve 16 may be varied by changing the effective area of annular shoulder 60, relative to the spring constant of compression spring 70.

Other aspects, objects and advantages of this invention can be obtained from a study of the drawings, the disclosure and the appended claims.

What is claimed is:

1. A variable flow venturi assembly for use in an exhaust gas recirculation system of an internal combustion engine, comprising:

a housing having an inner chamber, a combustion air inlet in communication with said inner chamber, and an exhaust gas inlet in communication with said inner chamber;

a venturi valve slidably disposed within said inner chamber, said venturi valve including a longitudinally extending throughhole with an inlet opening in communication with said combustion air inlet, an outlet opening and a venturi section interposed between and in communication with each of said inlet opening and said outlet opening, said venturi valve further including at least one bypass port and at least one induction port, each said bypass port in communication with said combustion air inlet and said throughhole, each said induction port in communication with said exhaust gas inlet and said throughhole; and an actuator for slidably moving said venturi valve within said inner chamber of said housing.

2. The variable flow venturi assembly of claim 1, wherein said actuator includes a pneumatic actuator.

3. The variable flow venturi assembly of claim 2, wherein said venturi valve includes an annular flange with an annular shoulder, said pneumatic actuator exerting a selective axial force against said annular shoulder to move said venturi valve within said inner chamber.

4. The variable flow venturi assembly of claim 3, wherein said annular flange includes an opposing annular shoulder and a spring biased against said opposing annular shoulder, said spring exerting a force against said annular flange which opposes said pneumatic actuator.

5. The variable flow venturi assembly of claim 1, wherein said at least one bypass port includes a plurality of bypass ports, said inner chamber including a smaller diameter portion in which said venturi valve is slidably disposed, each said bypass port being covered by said smaller diameter portion an amount which is dependent upon a selected position of said venturi valve within said inner chamber.

6. The variable flow venturi assembly of claim 5, wherein each said bypass opening is entirely open when said venturi valve is at a full bypass position within said inner chamber.

7. The variable flow venturi assembly of claim 5, wherein each said induction port terminates at a location downstream from said venturi section.

8. The variable flow venturi assembly of claim 1, wherein said inner chamber includes an annular recess and said at least one induction port comprises a plurality of induction ports, each said induction port in communication with said annular recess and said throughhole.

9. The variable flow venturi assembly of claim 8, wherein each said induction port terminates at a location adjacent to and downstream from said venturi section.

10. An internal combustion engine, comprising:

an intake manifold; and a variable flow venturi assembly, including:

a housing attached to said intake manifold, said housing having an inner chamber, a combustion air inlet in communication with said inner chamber, and an exhaust gas inlet in communication with said inner chamber;

a venturi valve slidably disposed within said inner chamber, said venturi valve including a longitudinally extending throughhole with an inlet opening in communication with said combustion air inlet, an outlet opening and a venturi section interposed between and in communication with each of said inlet opening and said outlet opening, said venturi valve further including at least one bypass port and at least one induction port, each said bypass port in communication with said combustion air inlet and said throughhole, each said induction port in communication with said exhaust gas inlet and said throughhole; and an actuator for slidably moving said venturi valve within said chamber of said housing.

11. The internal combustion engine of claim 10, wherein said actuator includes a pneumatic actuator.

12. The internal combustion engine of claim 11, wherein said venturi valve includes an annular flange with an annular shoulder, said pneumatic actuator exerting a selective axial force against said annular shoulder to move said venturi valve within said inner chamber.

13. The internal combustion engine of claim 12, wherein said annular flange includes an opposing annular shoulder and a spring biased against said opposing annular shoulder, said spring exerting a force against said annular flange which opposes said pneumatic actuator.

14. The internal combustion engine of claim 10, wherein said at least one bypass port includes a plurality of bypass ports, said inner chamber including a smaller diameter portion in which said venturi valve is slidably disposed, each said bypass port being covered by said smaller diameter portion an amount which is dependent upon a selected position of said venturi valve within said inner chamber.

15. The internal combustion engine of claim 14, wherein each said bypass opening is entirely open when said venturi valve is at a full bypass position within said inner chamber.

16. The internal combustion engine of claim 14, wherein each said induction port terminates at a location downstream from said venturi section.

17. The internal combustion engine of claim 10, wherein said inner chamber includes an annular recess and said at least one induction port comprises a plurality of induction ports, each said induction port in communication with said annular recess and said throughhole.

18. The internal combustion engine of claim 17, wherein each said induction port terminates at a location adjacent to and downstream from said venturi section.

19. A method of operating a variable flow venturi assembly in an exhaust gas recirculation system of an internal combustion engine, comprising the steps of:

providing a housing having an inner chamber, a combustion air inlet in communication with said inner chamber, and an exhaust gas inlet in communication with said inner chamber;

providing a venturi valve slidably disposed within said inner chamber, said venturi valve including a longitudinally extending throughhole with an inlet opening in communication with said combustion air inlet, an outlet opening and a venturi section interposed between and in communication with each of said inlet opening and said outlet opening, said venturi valve further including at least one bypass port and at least one induction port, each said bypass port in communication with said combustion air inlet and said throughhole, each said induction port in communication with said exhaust gas inlet and said throughhole;

moving said venturi valve in a slidable manner within said inner chamber of said housing using an actuator; and covering each said bypass port a selected amount dependent upon said moving step.

20. The method of claim 19, wherein said venturi valve includes an annular flange with an annular shoulder, and wherein said moving step comprises the substep of exerting a selective axial force against said annular shoulder with said actuator to move said venturi valve within said inner chamber.

21. The method of claim 20, wherein said annular flange includes an opposing annular shoulder, and comprising the further step of exerting a force using a spring against said annular flange which opposes said actuator.

22. The method of claim 19, wherein each said induction port is always uncovered, independent of said moving step.

23. The method of claim 19, wherein said actuator includes a pneumatic actuator.

* * * * *